United States Patent [19]

Hughes

[11] 4,094,176

[45] June 13, 1978

[54] PICK FOR TUBULAR CYLINDER LOCKS

[76] Inventor: Donald R. Hughes, 2600 Brower Ave., Simi Valley, Calif. 93065

[21] Appl. No.: 832,279

[22] Filed: Sep. 12, 1977

[51] Int. Cl.[2] ..... E05B 19/20

[52] U.S. Cl. ..... 70/394; 70/411

[58] Field of Search ..... 70/393, 394, 395, 397, 70/398, 404, 409, 411; 81/3; 33/174 F, 174 P, 174 H

[56] References Cited

U.S. PATENT DOCUMENTS

| | | | |
|---|---|---|---|
| 2,059,376 | 11/1936 | Lombardo | 70/394 |
| 2,070,342 | 2/1937 | Tarrie | 70/394 |
| 2,655,808 | 10/1953 | Wilson | 70/394 |
| 3,149,487 | 9/1964 | Martin | 70/394 |
| 3,330,141 | 7/1967 | Greenwald | 70/411 |

*Primary Examiner*—Robert L. Wolfe

*Attorney, Agent, or Firm*—Jack C. Munro

[57] ABSTRACT

A pick for tubular cylindrical locks which includes a central substantially cylindrical member which has a plurality of grooves thereon, each groove to accommodate an elongated pin. The pins are capable of axial movement with respect to the cylindrical member against the action of a frictional brake in the form of rubber O-ring assembly. The very tip of the pins connect with a head which is adapted to be placed about the rotatable cylinder portion of a tubular lock. The head includes a series of axial slots and upon being moved axially into the cylindrical member, the head slightly deflects and frictionally secures to the cylinder portion of the lock. The head is moved axially by a fastener which connects between the rearwardmost end of the first member and the head.

11 Claims, 15 Drawing Figures

PICK FOR TUBULAR CYLINDER LOCKS

BACKGROUND OF THE INVENTION

The subject matter of this invention relates to locksmith's tools and refers more particularly to a picking tool for cylinder locks of the type wherein the front end portion of a cylinder is rotatable within a casing and cooperates with the casing to define an annular keyway in which a tubular key is receivable, the key having a series of recesses on its front end that cooperates with spring biased tumblers in the lock which move parallel to the lock axis.

Tubular key cylinder locks are frequently used to gain access to coin boxes of vending machines, on switches that control electrical circuits of automobile burglar alarms systems, on coin boxes of gambling instruments, plus numerous other types of equipment. The tubular key that is accepted by the lock of this type is not as readily duplicated as a more conventional flat key intended for a cylinder lock having a slot-like key receiving aperture. Tubular key locks also have the further advantage that they cannot be picked by means of conventional picking tools. Upon occasion, however, there are legitimate reasons for having a tubular key type of lock picked by a locksmith. There have been known and patented picking devices for the tubular type of lock. However, such picking devices are not significantly efficient, and generally, even the most skilled locksmith will take a substantial period of time in order to open a tubular type of lock with such a device.

Previously, such picking devices have been designed to fit only one particular type of cylinder lock. In actual practice, there are several different sizes of cylinder locks with center pin sequences, offset left and offset right pin sequences. Therefore, the picking tools of the prior art are not adaptable to the non-conventional size of tubular cylinder lock, or the offset pin sequences.

Almost all tubular cylinder locks at the present time, include seven (7) in number of tumblers. However, there is currently being manufactured a tubular cylinder lock which includes eight (8) in number of tumblers. Known picking devices cannot, in any way, pick such a lock.

SUMMARY OF THE INVENTION

The lock pick of this invention provides for an inner of central member which is basically cylindrical in configuration and includes a series of evenly spaced apart longitudinal slots which are in axial alignment with the longitudinal axis of the member. Mounted on the member is an O-ring assembly. An elongated pin is to fit within each groove and in contact with the O-ring assembly. The O-ring assembly functions as a frictional brake as the pins are moved axially with respect to the member. A sleeve is located about the pins to maintain such within their respective grooves. Interiorly of the forward end of the member is a hollow chamber. Any one of a plurality of different sized heads is to be locatable within the chamber with the forward end of the pins being slideable in respect thereto. A fastener extends through the cylindrical shaped member with the longitudinal axis of the fastener coinciding with the longitudinal axis of the member. The fastener extends from the back end of the member to connect with the head located within the interior chamber. The head includes at least one axial slot which permits a slight inward deflecting of the head upon tightening of the fastener. This is for the purpose of securing the lock pick to the rotatable cylinder of the lock when the lock pick is being used. As the pick is being used, each of the elongated pins connect with a spring biased tumbler within the lock. As the lock pick is used, the elongated pins are moved rearwardly until the position of each of the tumblers is along the shear line thereby permitting rotation of the rotatable cylinder of the lock with respect to the casing of the lock. Decoding means to ascertain the key code for the lock is provided within the lock pick of this invention.

The primary objective of the lock pick of this invention is to design a lock pick which can quickly and easily effect picking of the tubular cylinder type of lock, without requiring a great deal of expertise.

Another objective of this invention is to design a lock pick which is capable of picking every known type of tubular cylinder lock.

A further advantage of this invention is that it is constructed of few parts, can be readily assembled and therefore can be manufactured inexpensively.

A further advantage of this invention is that the device incorporates a decoding gauge so that once the tubular cylinder lock is "picked", the key code can be readily ascertained for the making of a key to operate the lock.

DETAILED DESCRIPTION OF THE SHOWN EMBODIMENT

Figure 1:
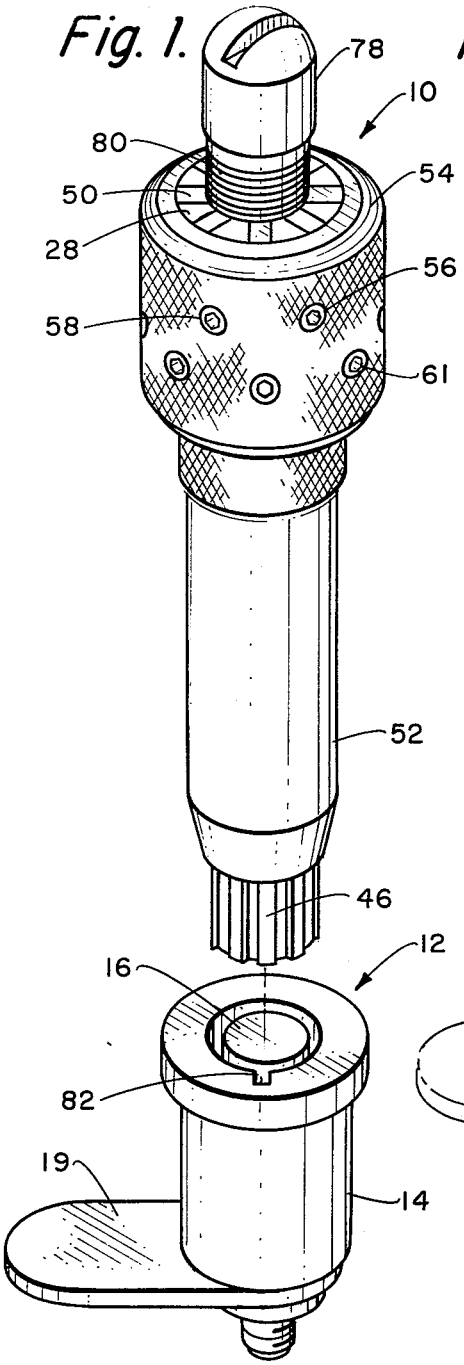
FIG. 1 is an exploded isometric view of the lock pick of this invention showing the operational arrangement with a lock.

Referring in particular to the drawings, there is shown the lock pick 10 of this invention which is to be employed to "pick" the tubular type of cylinder lock 12. Basically, the lock 12 includes a casing 14 within which is rotatably mounted a cylinder 16. The cylinder 16 connects to a locking flange 19. Normally, the cylinder 16 is locked to the casing 14 and is not rotatable in respect thereto. Therefore, the locking flange 19 can be positioned to lock an exterior form of apparatus (not shown). Within the casing 14 is supported a plurality of tumblers 18 located in a circular pattern. Each of the tumblers 18 include a spring 20 operating against a pair of in-line tumblers 22 and 24. Tumblers 18 cooperate within appropriate openings formed within the cylinder 16. In order for the cylinder 16 to rotate with respect to the casing 14, the tumblers 22 and 24 of all of the tumblers 18 must be positioned so that the gap between each pair of tumblers 22 and 24 is located in an in-line position with a connection between the rotatable cylinder 16 and the casing 14. This is called the shear line and rotation of the cylinder 16 with respect to casing 14 is now permitted.

To accomplish the locating of the abutting surfaces of each of the tumblers 18 at the shear line, the lock pick 10 of this invention is to be used.

The lock pick 10 provides for an inner, substantially cylindrical member 26. The member 26 includes a back end 28, a front end 30 interconnected by a side wall 32. The member 26 includes a plurality of evenly spaced apart slots 34 extending through the side wall 32. The member 26 also includes a central axially located opening 36. The opening 36 is to connect with a hollow interior chamber (not shown) located within the front end 30. Formed within the sidewall 32 is a annular groove 38. To be located within the annular groove 38 is a pair of O-rings 40 and 42. The function of the O-rings 40 and 42 will be explained further on in the specification.

To be located within each groove 34 is an elongated pin 44. It is to be noted that there are eight in number of grooves 34, each evenly spaced from each other, and therefore there can be eight in number of pins 44. The forwardmost tip 46 of each pin 44 is shown to be narrow and thin. The narrow tip connects to a main body section 48 which, in turn, connects to an enlarged rear section 50. It is to be noted that each of the pins 44 are identical in configuration and are to be used in conjunction with a seven-pin tubular lock.

With each of the pins 44 located within a groove 34, each pin 44 will then be in physical contact with the O-rings 40 and 42. It is to be noted that each of the pins 44 is permitted a certain amount of sliding movement with respect to the member 26. The O-rings 40 and 42 function as a frictional brake to prevent free movement of the pins 44. In other words, in order to move the pin 44, it must be physically forcibly moved. A great degree of force is not required, but a small amount of physical force must be exerted against each of the pins 44 in order to move it.

To keep the pins 44 in position within its respective groove 34, a sleeve 52 is located about the pins 44 and also about the cylinder 26. Located about the rearwardmost end of the member 26 is a collar 54. The collar 54 includes first set screws 56 and 58 which are to be located respectively within recesses 59 and 60 to lock the collar 54 onto the member 26. Also included within the collar 54 are a plurality of evenly spaced apart set screws 61. There is a set screw for each pin 44 and by tightening the set screws 61, each of the pins become fixedly secured to the member 26. The reason for this is that once a particular unlocking combination is achieved, the device 10 can be fixed in that position and therefore the device 10 will then operate merely as a key. A head 62 is to be locatable within the interior chamber formed within the front end 30 of the member 26. The head 62 includes a screw threaded opening 64 formed within a thin shank 66. The head 62 includes an enlarged section 68 which has formed therein a plurality of evenly spaced apart elongated grooves 70. Each groove 70 is to cooperate with a tip portion 46 of a pin 44. Within the forwardmost end of the head 62 is an internal opening 72. The cylinder 16 of the lock 12 is to be positioned within the opening 72 when the device is in use. Also formed within the head 62 are a plurality of spaced apart elongated axially located slits 74.

With the head 62 located within the front end of member 26, the threaded fastener 76 threadably engages the threaded opening 64. The enlarged end cap 78 of the threaded fastener 76 is located in abutting contact with the end 28 of the member 26. It can be seen that as the fastener 76 is tightened, the further the head 62 is moved within the chamber formed within the front end of the member 30. In accomplishing this movement, the head 62 is forced into engagement with the tips 46 of the pins 44. Because the pins 44 are fixed in position by means of the sleeve 52 and abutment of the head against the inner chamber formed within the front end of member 30 is apparent, a force tends to cause the head 62 to inwardly deflect which is permitted by reason of the slot 74. This inward deflection results in a tight grip upon the cylinder 16 of the lock 12. Thus, in essence, when the device 10 is installed upon the lock 12, the device 10 is affixed to the lock 12 and for all practical purposes, is formed as an integral part thereof.

Figure 2:
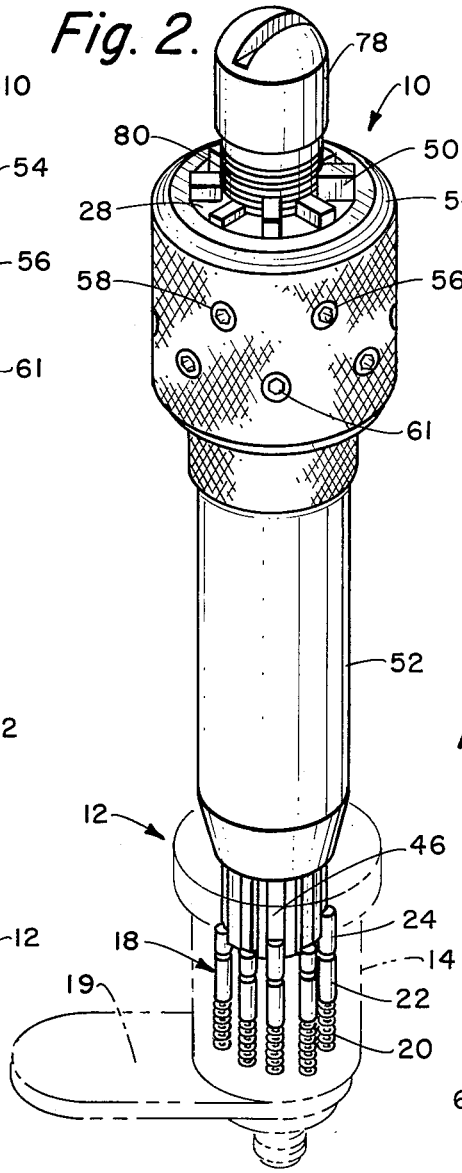
FIG. 2 is a view similar to FIG. 1 but showing the lock in phantom to show the interrelationship between the lock pick and the lock.

Located upon the end cap 78 are a series of closely spaced apart grooves 80. With the device 10 in the position for operation, the back end of each enlarged end 50 of pin 44 is flush against the surface 28 as shown in FIG. 1 of the drawings. During operation of the device of this invention, the pins 44 are moved to the position shown in FIG. 2 of the drawings with each pin assuming, in all probability, a different height. By closely observing the number of the grooves 80, that each of the enlarged section 50 of pins 44 has overlapped, the key code can be established. The presently used key code numbers between zero and seven with seven being the deepest groove within the key and zero being, in essence, no groove within the key. It is the depth of these grooves in the key that pushes its respective tumblers 18 in the lock 12 to the position which establishes the abutting separations between the tumblers 22 and 24 to coincide with the shear line of the lock 12. Therefore, once the key code is established by reading the "depth" of each enlarged end 50 of pins 44 against the series of grooves 80 of end cap 78, the code can then be used to manufacture a key for the particular lock 12.

Figure 5:
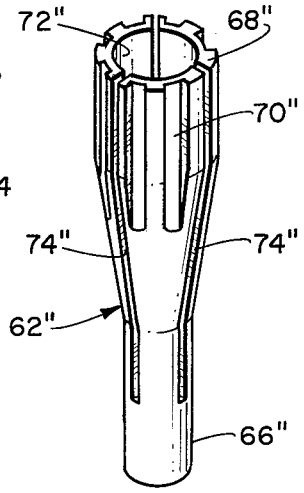
FIG. 5 is a third embodiment of lock picking head which is to be employed with a further different type of lock.
Figure 3:
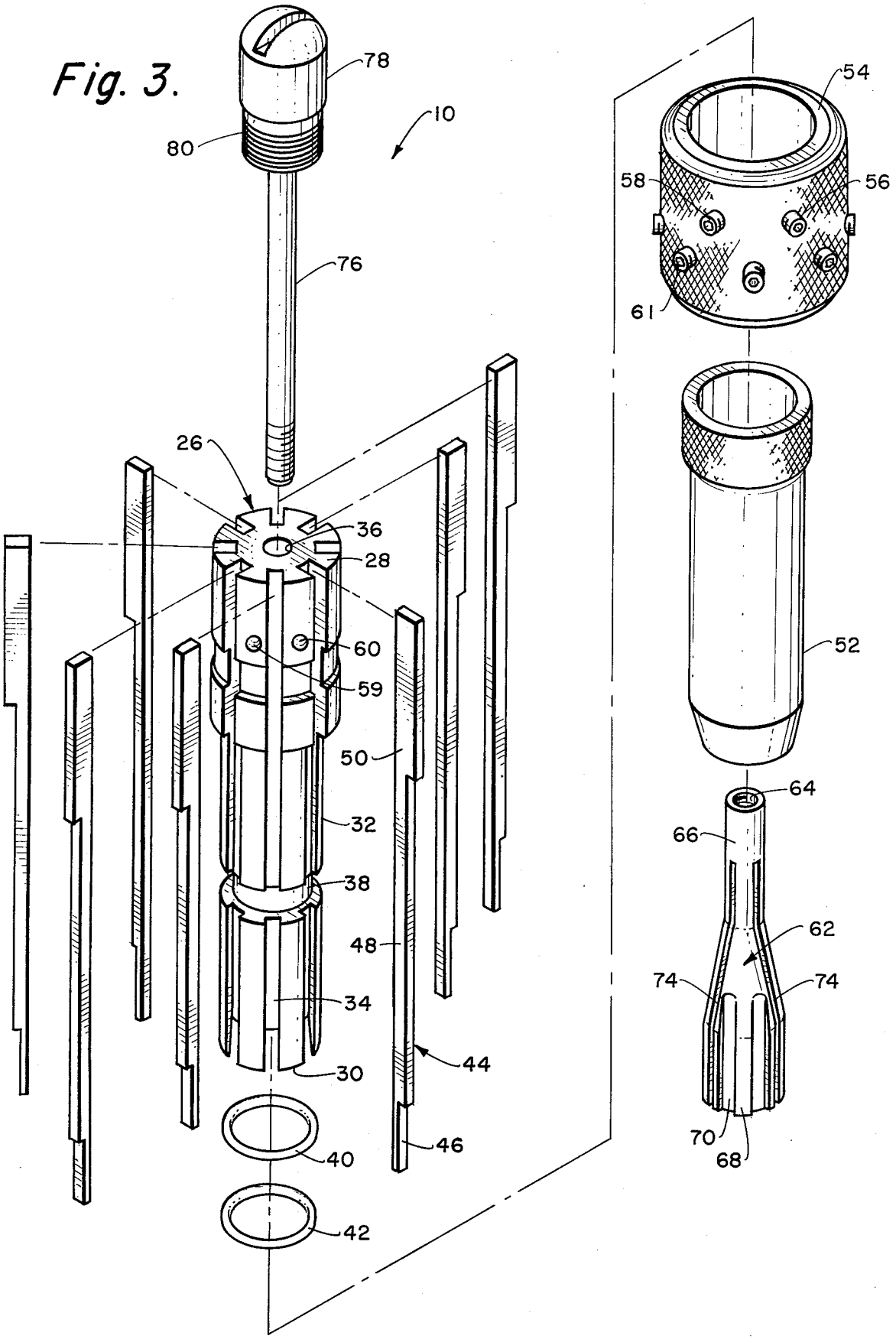
FIG. 3 is an exploded isometric view of the lock pick of this invention.
Figure 9:
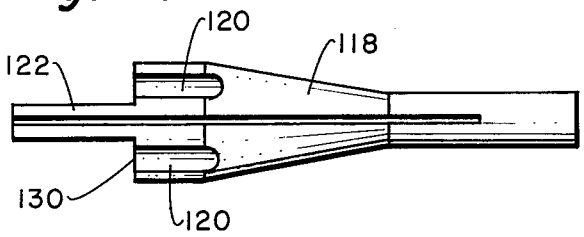
FIG. 9 is an elevational view of a fourth embodiment of lock picking head which is to be employed with a still further different type of lock.
Figure 10:
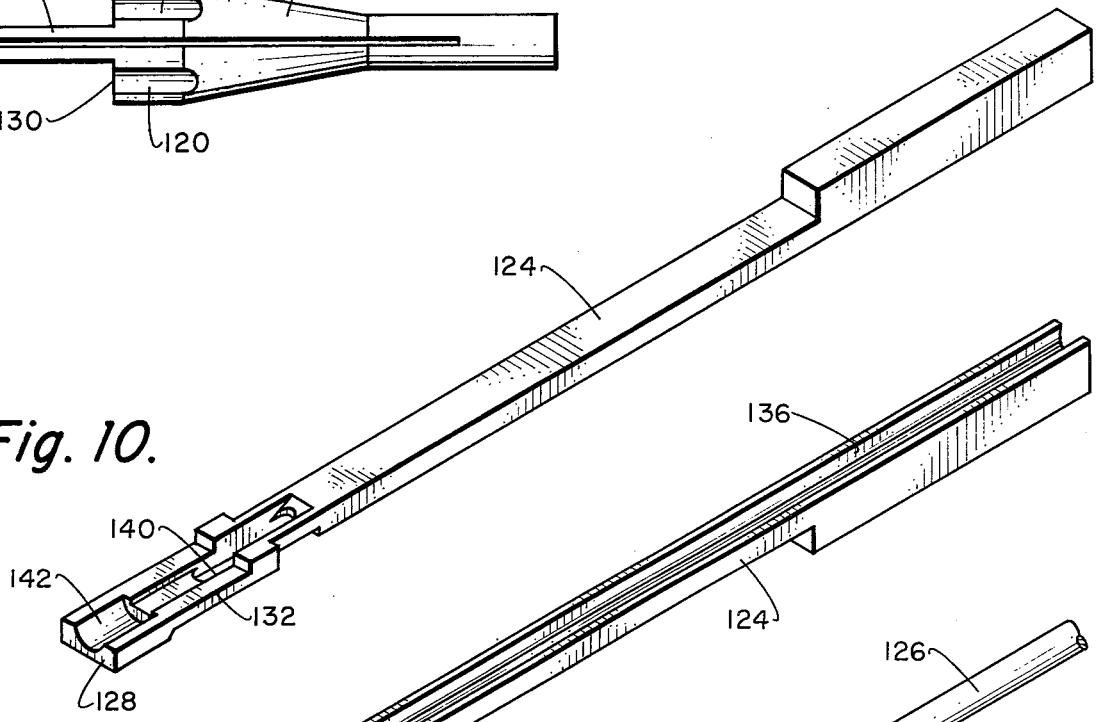
FIG. 10 is an isometric view of an outer elongated pin which is to be employed within the embodiment of head shown within FIG. 9.
Figure 11:
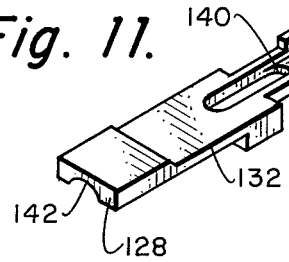
FIG. 11 is a view of the outer pin shown in FIG. 10 but with the pin in an upside down position.
Figure 12:
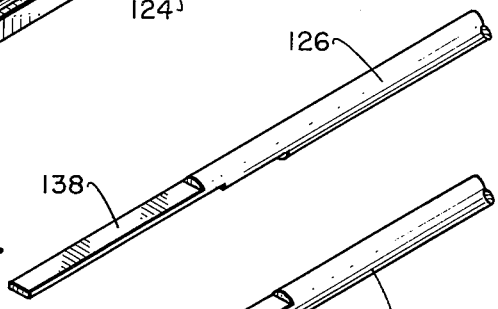
FIG. 12 is an isometric view of an inner pin which is employed in conjunction with the outer pin shown in FIGS. 10 and 11.
Figure 13:
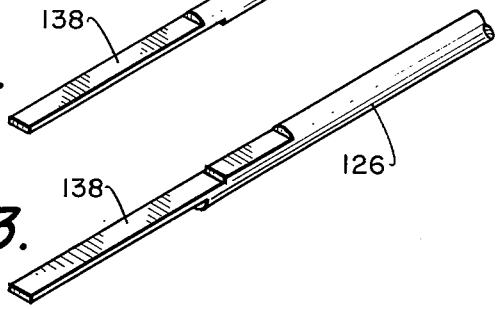
FIG. 13 is an isometric view of the pin of FIG. 12 but with the pin in the upside down position.

It is to be noted that within the embodiment of FIG. 3, there are shown eight in number of the slots 34. However, there are only seven in number of the pins 44 which means that there is one slot 34 that does not have a pin 44. The type of head 62 is of the type shown in FIG. 5 in which there are only seven grooves 70. Where there is no groove, that is the area to be placed directly in line with notch 82 of the lock 12. This means that the lock 12 is a seven tumbler lock and there will be a pin 44 for each tumbler. The only difference between the head 62 and the head 62'' is that the head 62'' is physically larger than head 62. This means that the opening 72'' is slightly larger than the similar opening within the head 62. Clearly, the head 62'' can be substituted for the head 62 to accommodate a lock (not shown) that has a slightly increased diameter of rotatable cylinder 16.

Figure 6:
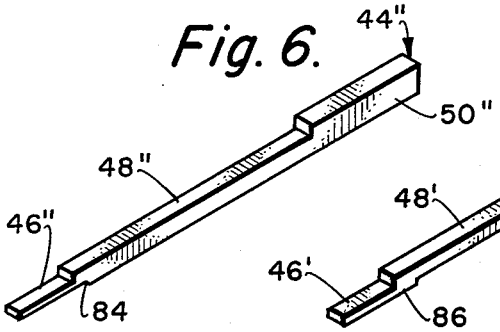
FIG. 6 is an isometric view of one of the elongated pins employed within the lock pick of this invention which is designed to be used in conjunction with the largest type of head, such being shown in FIG. 5.

Because the head 62'' is slightly larger, the pin 44 is not capable of being used with the head 62''. Therefore, the pin 44'' of FIG. 6 is to be employed with head 62'' of FIG. 5. Like numerals have been employed to refer to like parts. In comparing pins 44 and 44'', the only difference is in the area of the tip 46 and 46''. The tip 46'' on the bottom surface of pin 44'' is relieved to include relief 84. This relief 84 is necessary because of the increased size of head 62''.

Figure 7:
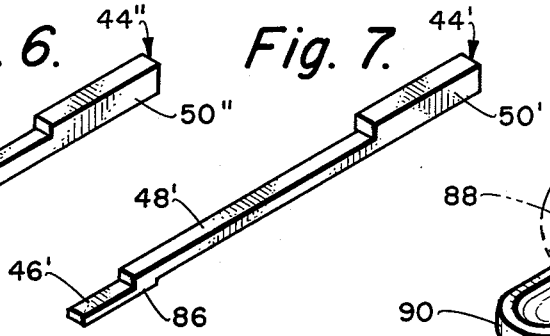
FIG. 7 is an isometric view of a further embodiment of an elongated pin which is designed to be employed in conjunction with the smallest diametered head.

Another embodiment of head (not shown) could be employed which is basically identical in appearance to head 62 and 62'' except that the diameter of openings 72 and 72'' is smaller in diameter than the opening within the heads 62 and 62''. This type of head would accommodate a smaller diametered rotatable cylinder 16. When using this type of head, the pin 44' shown in FIG. 7 would be employed. Instead of a relief on the bottom surface of tip 46', there is a protrusion 86.

Figure 4:
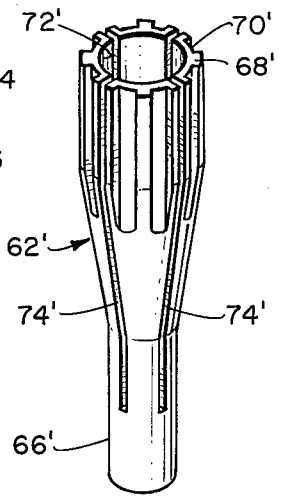
FIG. 4 is a second embodiment of lock picking head which is to be employed with a particular type of lock.
Figure 8:
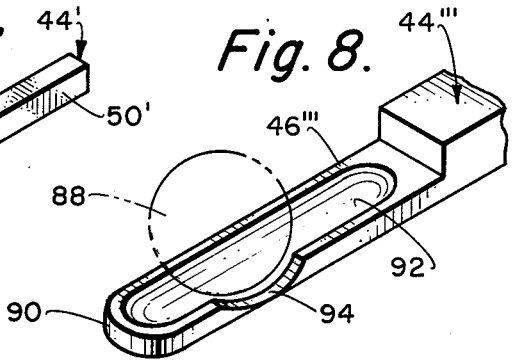
FIG. 8 is an isometric view of the forward portion of an elongated pin which is designed to be employed in conjunction with the head shown in FIG. 4.

Referring particularly to the head 62' of FIG. 4, like numbers again have been used to refer to like parts. The distinction of the head 62' from the heads 62 and 62'' is that there are eight in number of the grooves 70' instead of seven in number with embodiments 62 and 62''. When using head 62', there will be a pin 44' within each of the grooves 34 except there will be a pin 44'' located in the top center groove located between the recesses 59 and 60 of inner member 26 so there will be seven in number of the pins 44 plus one in number of pin 44''. This particular type of lock does not have a notch 82, but does have a movable ball located within the casing of the lock. This ball, represented in phantom lines as number 88 in FIG. 8, must be located within a certain position or rotation of the cylinders 16 with respect to the casing 14 will not be permitted. Also, there is a tumbler 22 and 24 located behind the ball 88. This means that a pin, such as shown in FIG. 8 as pin 48''', must be employed to move past the ball 88, position the ball in the correct position, and then the tip 90 of the pin 44''' is to operate against its respective tumblers 22 and 24. The tip 46''' of the pin 44''' includes an elongated recess 92. As the head of the device 10 is inserted within the annular opening of the lock, the forward end 90 of the pin 44''' raises the ball 88, and as the device 10 is further inserted, the ball will then come to rest within the groove 92. This positions the ball 88 so that the ball 88 does not function as a lock. Therefore, upon "picking" of the lock and when the separation of the abutting surfaces of the tumblers are all located within the shear line of the lock 12, the cylinder 16 is rotatable with respect to the casing 14. During the rotational movement, the ball 88 remains within the groove 92 of the tip 46'''. It is to be noted that the recess 94 is an emergency escape means to remove the pin 44''' from the lock 12 in a circular direction rather than by an in and out movement when the cylinder 16 of the lock 12 is being rotated to the open position. When the cylinder 16 of the lock 12 is rotated in the opening direction, the ball 88 located within the groove 92 moves with the said cylinder 16. In any other location than in the locked location, the ball 88 is not free to be lifted within the cylinder 16 as there is no recess for the ball 88 to raise into. Because of this, the tip 46''' of the pin 44''' can only be removed by pulling straight out when the notch 82 is located directly over the ball 88. In all other locations, and especially when the cylinder 16 of the lock 12 is being rotated to the opening position, the tip 46''' of the pin 44''' can only be removed by a circular motion to allow the ball 88 to escape out through the recess 94.

The operation of any one of the embodiments of this invention is as follows: The device 10 is to be positioned as shown in FIG. 1 of the drawings cooperating with lock 12. This cooperation is when cylinder 16 is located within the internal opening in the front end of head 62. The operator then tightens the fastener 76 by turning end cap 78. This causes the head 62 to be retracted further within the internal opening and the head 62 is squeezed tightly upon the cylinder 16 by the tapered exterior surface of the head 62 coming into contact with the matingly tapered chamber formed within the forward end of the member 30 (not shown). The device 10 is now ready to be employed to pick the lock 12.

At this particular point, in essence, the rotatable cylinder 16 and the device 10 has now become an integral unit. The operator then holds the knurled surface on the collar 54 and attempts to turn the device 10. The amount of turning movement at this particular time will be no more than a fraction of an inch because the tumblers are not aligned at the shear line. But what has occurred is one or more sets of the tumblers are tightly "bound up" at the shear line of the lock 12. The operator then pushes inward on the device 10 still holding the torqueing tension and this amount of movement is no more than the distance between adjacent grooves on the decoding gauge 80. What occurs in the tumbers which are "bound up" at the shear line causes its respective pin or pins 44 to move rearwardly. The operator then releases the device 10, permitting its return to the outer position and then turns the device 10 in the opposite direction and repeats the inward movement. The same tumbler or tumblers that were "bound up" previously may again bind up and as the device is moved inwardly they will push the respective pin or pins 44 again a distance equal to the spacing between adjacent grooves of the decoding gauge 80. This procedure is repeated until the separation between the abutting surfaces of the pins 22 and 24 are located within the shear line of the lock 12. Once the shear line is reached, the slight turning of the device 10 will not "bind up" that particular tumbler or tumblers, as they will now be located wholly within their respective chambers. However, other tumbler or tumblers within the series of tumblers will then become "bound up" and turning pressure with an inward movement of the device 10 will cause rearward movement of their respective pins 44. It is to be noted that at this particular time, because the previous tumblers are not "bound up" that inward movement of the device 10 has no effect on the established location of their respective pins 44. Because the tumblers are wholly contained within their respective chambers, and the separation of the abutting surfaces of said tumblers 22 and 24 are located within the shear line of the lock 12. they cannot bind to move the pins 44 in a rearward direction.

This procedure is repeated until the shear line for each of the tumblers 22 and 24 is located at which time when the operator makes the movement either clockwise or counterclockwise the tumber 16 rotates and the lock 12 is then opened.

Figure 14:
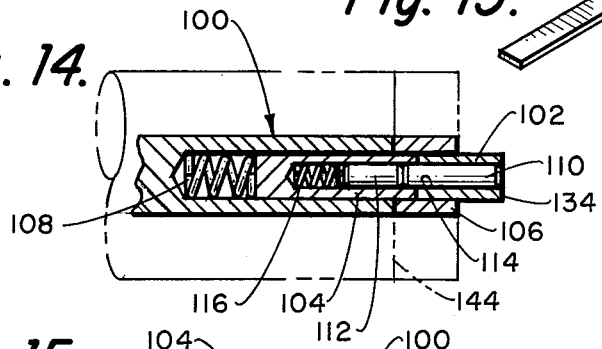
FIG. 14 is a cross-sectional view taken through one of the tumblers of the type of lock with which the structure of FIGS. 9 to 13 will be employed, the tumbler assembly being located in the lock position.
Figure 15:
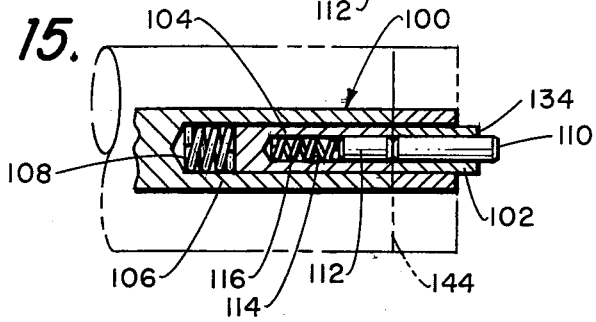
FIG. 15 is a view similar to FIG. 14 but showing the tubular assembly in the openable position.

Referring particularly to FIGS. 9 to 15, there is shown a different type of lock structure in FIGS. 14 and 15 and the lock picking apparatus within FIGS. 9 to 13 in order to effect opening of the lock of FIGS. 14 and 15. The type of lock within FIGS. 14 and 15 employs a tumbler assembly 100 which is similar to tumbler assembly 18 in that there is an outer tumbler 102. The tumblers 102 and 104 are in alignment with each other within a casing shown in phantom line position forming a part of the overall lock structure. A spring 108 exerts a bias against the inner tumbler 104 tending to move such to the outermost position. It is to be understood that there will be a substantial number of such tumbler assemblies 100 and general eight to ten.

The primary distinction of the type of lock within FIGS. 14 and 15 is that there is a second outer tumbler 110 and a second inner tumbler 112. Movably mounted and also located in an inline position within a chamber 114 located within the tumblers 102 and 104. A second spring 116 exerts a bias against the tumblers 110 and 112 tending to position such in an extended position.

The difficulty in affecting picking of the lock within FIGS. 14 and 15 arises from the fact that within each tumbler assembly within the lock, not only must tumblers 102 and 104 be correctly positioned at the shear line, but also each pair of tumblers 110 and 112 must also be located at the shear line. This would normally be an extremely difficult thing to do with the use of conventional lock picking structure.

However, by using the structure of FIGS. 9 to 13, it only takes a semi-skilled person a very short period of time in order to "pick" a lock constructed in accordance with FIGS. 14 and 15.

The lock pick head 118, which is essentially similar to head 62 and connects with the lock picking apparatus in precisely the same way and operates in the same manner, includes a plurality of grooves 120 which are also essentially similar to the grooves 70. The head 118 differs in that the front portion of the head has a protrusion 122 which is to position the head 118 within a lock (not shown) which is essentially similar to the lock 12 which has been previously described. The exception being that the head 118 includes a positioner in the form of the protrusion 122.

Within each of the grooves 120 is to be located a pin assembly taking the form of the interconnected pins 124 and 126. The main body of pin 124 matingly cooperates within a groove 120. The front face 128 of the pin 124 is to be flush with the front face 130 of the head 118 when the lock picking process is to begin. The pin 124 is to be so located within the lock so the front portion 132 of the pin 124 comes into contact with the cylinder portion of the lock which is essentially equivalent to cylinder portion 16 of lock 12. This means that referring in particular to FIGS. 14 and 15 the front face 128 is to be in contact with the portion 134 of the tumbler 102 assuming the longitudinal center axis of the lock of FIGS. 14 and 15 would be in the direction of the bottom of the drawing. Therefore, it is apparent that the pin 124 operates against the outer tumbler 102 and does not have any direct connection to the tumbler against the outer tumbler 110.

Pin 126 is to fit within channel 136 of pin 124. The front portion 138 of the pin 126 extends through opening 140 of the pin within the front portion 132 of the pin 124. The very tip portion of the front portion 138 is located within the recess area 142 formed within the front portion 132. As a result, the pin 126 is slideably movable with respect to the pin 124. The very tip portion of the pin 126 is in contact with the outer tumbler 110.

When initiating the picking process, the head 118 is secured to the cylinder portion of the lock (such as cylinder 16 of lock 12). The surface 128 of the pin 124 is in abutting contact with the surface 134 of the tumbler 102. The tip 138 of the pin 126 is in contact with the outer tumbler 110. It is to be noted that both the pins 126 and 124 will be in direct physical contact with the frictional break in the form of the O-rings 40 and 42. The contact with the O-rings occurs across the channel 136. Both pins 124 and 126 will move independently along their longitudinal axis acting against the frictional breaks 40 and 42 until the abutting exterior surfaces of the tumblers 102 and 110 are in alignment with the shear line 144 of the lock (shown in FIGS. 15).

During the previously mentioned torquing movement in order to achieve the "blinding up" of the tumbler assemblies, the initial torquing first causes the tumblers 110 and 112 to be affected. Continued operation of the picking device will cause, at this time, only the pin 126 to be affected until such time the joint between the tumblers 110 and 112 is located at the shear line 144.

Continued operation of the lock pick will then cause the tumblers 102 and 104 to act against the pin 124 until the separation point between the tumblers 102 and 104 is also located at the shear line 144. When all the separation surfaces within each of the tumbler assemblies are located at the shear line 144, the lock is then free to open.

What is claimed is:

1. A pick for tubular cylinder locks comprising:

a substantially cylindrical first member having a front end and a back end interconnected by a side wall, said front end having a hollow interior chamber;

a plurality of elongated spaced apart pins slideably mounted within grooves located within said side wall of said first member;

confining means maintaining said pins in connection with said first member;

head locatable within said hollow interior chamber of said first member, said head having an internal recess for connection with the rotatable cylinder portion of a lock, said pins connecting with said head being movable in respect thereto, whereby said head is connected to a cylinder portion with each said pin in contact with a lock tumbler and upon slight axial in and out movement of said head the said pins act against said tumbler and said pins are moved axially.

2. The pick as defined in claim 1 wherein:

said head including releaseable securing means for fixedly attaching said head to the cylinder portion of the lock.

3. The pick as defined in claim 2 wherein:

said securing means comprises axial slot means formed within said head, whereby said head is capable of being slightly deflected into tight frictional engagement with the cylinder portion of the lock.

4. The pick as defined in claim 1 including:

friction means in contact with said pins, said friction means permitting axial movement of said pins but functioning to hold said pins in the established axial position when such has been achieved.

5. The pick as defined in claim 1 wherein:

said confining means comprising a sleeve surrounding a portion of said first member and said pins.

6. The pick as defined in claim 1 wherein:

each of said pins being capable of being secured in a particular established position with respect to said first member.

7. The pick as defined in claim 1 including:

a fastener interconnecting said back end of said first member and said head, said fastener extending through said hollow interior chamber.

8. The pick as defined in claim 7 including:

a decoding gauge formed upon said fastener, said decoding gauge located directly adjacent the back end of said pins, whereby upon the desired axial movement of said pins being obtained the position of said pins can be readily determined by said decoding gauge therefore the code for the key to operate the lock can be readily ascertained.

9. The pick as defined in claim 1 including:

one of said pins including an elongated recess, said elongated recess formed within the tip portion of said pin which is adapted to be located within the confines of the lock, said recess to accommodate a ball locking member which is part of the lock.

10. The pick as defined in claim 1 including:

there being a pair of pins located within each said groove, each said pair of said pins are independently slideably mounted with respect to each other, whereby each said pin is to be in contact with a separate lock tumbler.

11. The pick as defined in claim 10 wherein:

said head including an elongated protuberance extending from said head, said elongated protuberance being adapted to connect with a lock to correctly position the head within the lock.

* * * * *